US005390126A

United States Patent [19]

Kongho et al.

[11] Patent Number: 5,390,126

[45] Date of Patent: Feb. 14, 1995

[54] EMBROIDERING DATA PRODUCTION SYSTEM

[75] Inventors: Takeshi Kongho; Takashi Nakamura, both of Tokyo, Japan

[73] Assignee: Janome Sewing Machine Co., Ltd., Tokyo, Japan

[21] Appl. No.: 837,163

[22] Filed: Feb. 18, 1992

[30] Foreign Application Priority Data

Feb. 22, 1991 [JP] Japan ..... 3-048638

[51] Int. Cl.[6] ..... G06F 15/46; D05B 3/02; D05B 19/00

[52] U.S. Cl. ..... 364/470; 112/456; 112/453; 112/121.11; 112/457

[58] Field of Search ..... 364/470; 112/121.11, 112/121.12, 457, 458, 456

[56] References Cited

U.S. PATENT DOCUMENTS

| | | | |
|---|---|---|---|
| 3,722,434 | 3/1973 | Strother et al. | 112/79 |
| 4,326,473 | 4/1982 | Kigawa | 112/458 |
| 4,434,732 | 3/1984 | Salge et al. | 112/445 |
| 4,475,784 | 10/1984 | Lukawich | 339/43 |
| 5,179,520 | 1/1993 | Hayakawa | 364/470 |
| 5,210,694 | 5/1993 | Hayakawa | 364/470 |

*Primary Examiner*—Paul Gordon

*Attorney, Agent, or Firm*—Westman, Champlin & Kelly

[57] ABSTRACT

The present invention stores the image data of an original image pattern read by an image reader in processed data storage means, and stores the calculation formulas for producing designs such as checkers and strip patterns in calculation formula storage means. And, the needle location data of a selected design is generated by substituting the line and column numbers of the image data in the calculation formulas stored in the calculation formula storage means. By this construction, within the image data, embroidering data of the design which is not affected by the visible outline thereof can be formed. In addition, by carrying out the logical AND between the data of the needle locations corresponding to a design and the image data of an original data, embroidering data of the design which is not affected by the visible outline of the image data is formed within the image data.

7 Claims, 13 Drawing Sheets

| |
|---|
| FIG. 5A |
| FIG. 5B |

EMBROIDERING DATA PRODUCTION SYSTEM

BACKGROUND OF THE INVENTION

1. Field of the Invention

The present invention is related to an embroidering data production system, and particularly, to an embroidering data production system wherein an attractive embroidery pattern can be formed by producing needle location data within a figure so as not to be affected by the visible outline of the figure.

2. Description of the Prior Art

For instance, U.S. Pat. 3,722,484 issued Mar. 27, 1973, to Strother et al has disclosed a data storage system in which a replica of a desired pattern is optically read by a scanner and thereafter converted to electrical signals, which are input to a data recorder and stored in a punch card.

The above-mentioned data storage system merely changes black and white data read by a scanner to electrical signals and stores them in the punch card, and cannot perform a processing of conversion to sewing data of a predetermined pitch such as required by the current embroidering machine.

In addition, there has been a system in which, after the image processing of original image data input from an image input device, the worker instructs sewing order, sewing pitch, etc. to produce embroidering data.

In such system, however, the operation by the worker requires special knowledge and skill, and thus it is not suitable for domestic-use machines.

Also, a technique of mounting external storage means on the data reading section of the machine main body for use as auxiliary storage means of the machine is disclosed, for instance, in U.S. Pat. No. 4,475,784 issued Oct. 9, 1984 to Lukawich.

SUMMARY OF THE INVENTION

It is the object of the present invention to provide an embroidering data production system, which can automatically produce a desired design of needle locations within a figure without being affected by the visible outline of the figure.

The present invention is characterized, in order to accomplish tile above object, by comprising calculation formula storage means in which needle location data corresponding to a design are stored, and embroidering data generating means for applying line numbers of the image data and row numbers of the start and end points or each row to the calculation formulas thereby to generate left to right needle location data and right to left needle location data.

In addition, the present inventions further characterized by comprising needle location data storage means in which needle location data corresponding to a design are stored, and AND operation means for carrying out the logical AND between the image data and needle location data from the needle location data storage means.

BRIEF DESCRIPTION OF THE DRAWING

FIG. 5 is an illustration showing tile connection of

FIGS. 5A and 5B, which are a flowchart of a conversion program from the image to stitch data of the embroidering machine of the present invention.

DETAILED DESCRIPTION OF THE PREFERRED EMBODIMENTS

Figure 1:
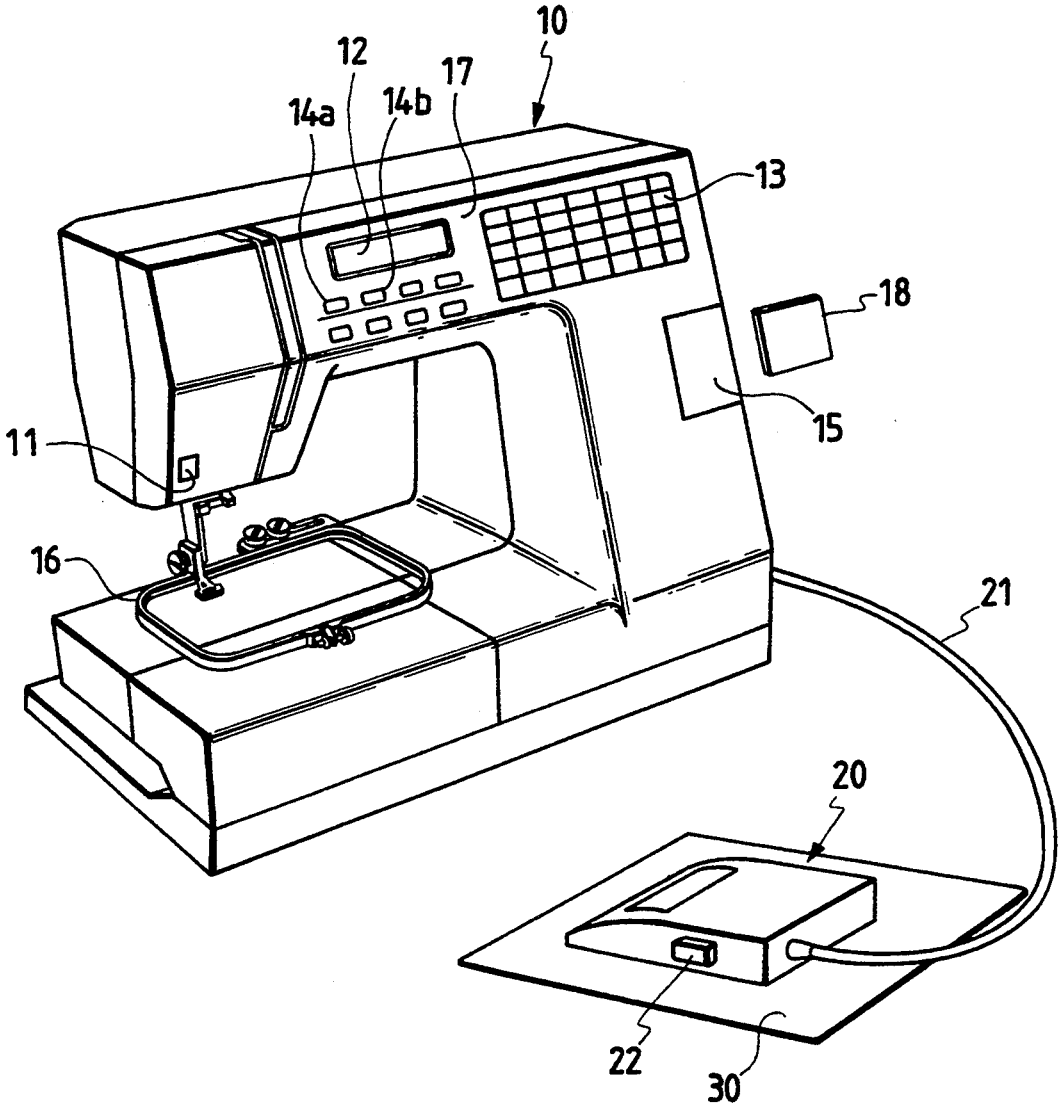
FIG. 1 is a perspective view of the embroidering machine to which tile present invention is applied.

Now, the present inventions described in detail with reference to the drawing. FIG. 1 shows the external perspective view of the embroidering machine to which the present invention is applied.

In the figure, 10 represents an embroidering machine which enables a pattern sewing by a standard needle and cloth feed, and an embroidery sewing in which an embroidery frame is driven, and on the front panel 17 of embroidering machine 10, there are provided start/stop key 11 for starting and stopping the machine, liquid crystal display 12, pattern selecting section 13, operation key section 14, and card reader/writer section 15 for reading/writing data from/to RAM card.

16 is an embroidery frame for holding embroidery cloth, and the embroidery frame is detachably fixed to a carriage which is driven by X-Y driver means, not shown, in the X-axis and Y-axis directions. The construction of the driving of the embroidery frame 16 is described in Japanese Patent Application No. 134217/1990 filed by the present applicant, and thus explanation thereof is omitted.

The operation key section 14 includes image scanner input mode key **14*a*, embroidering data conversion key 14*b* for instructing conversion of the original image data read in from the original image input device described later to embroidering data, etc. Further, on the liquid crystal display 12**, a message for instructing the sewer on the machine operation procedure, the original image data read in from the original image input device, etc. are displayed.

20 is an image scanner as an example of the original image input device, and read start button 22 is provided in a side thereof. The image scanner 20 is electrically and mechanically connected to embroidering machine 10 via dedicated cable 21 and a plug, not shown.

30 is a sheet of paper on which an original image pattern is drawn. As the sheet 30, white paper is preferably used, and on this paper, an original image pattern of characters, pictures, etc. having a line width of 1 mm or thicker is drawn with a black pen or the like.

As the image scanner 20, for instance, the one having an effective read width of 63 mm, binary tone output of black and white, and 504 main scan effective picture elements can be used.

Figure 3:
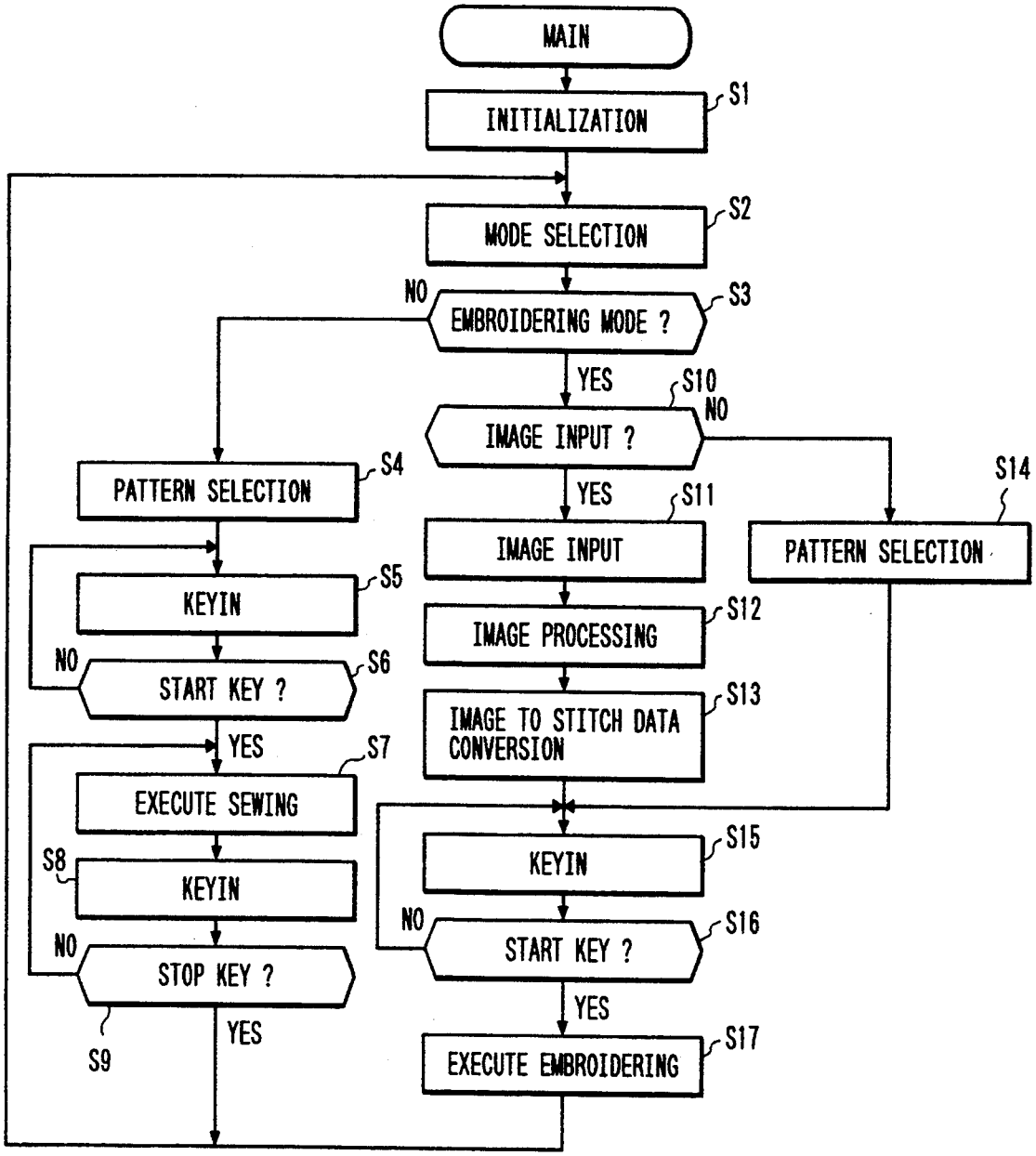
FIG. 3 is a flowchart showing the general operation of the embroidering machine.

The outline of the hardware configuration of the embroidering machine 10 is now described with reference to the block diagram of FIG. 4. Incidentally, those same as or identical to FIG. 3 are represented by the same symbols with or without a subscript.

In the figure, 40 is a central processing unit for controlling the overall operation of the embroidering machine. 41 is image data storage means for storing the image data read by the image reader 20. 42 is data processing means for performing the processings such as removal of noises from the stored image data in the image data storage means 41, and 43 is processed data storage means for storing the data processed in the data processing means 42.

Further, 44 is embroidering data storage means, in which embroidering data converted by central processing unit 40 from the data stored in the processing data storage means 43 is stored. The embroidering data storage means 44 corresponds to RAM card 18 mounted on the card reader/writer section 15.

45 is internal pattern storage means, and 46 is program storage means. Stored in the program storage means 46 are image processing programs such as a program for controlling the data processing means 42 and a program for converting the data stored in the processed data storage means 43 to embroidering data, a control program for controlling the overall operation of the embroidering machine, etc.

In addition, 47 is rotational speed instructing means, which corresponds to a controller or the like that can be freely operated by the sewer. 48 is a machine motor driver circuit which operates in response to the rotational speed instructing means, and 49 is a machine motor. 50 is machine motor's rotational speed detecting means for detecting the rotational speed of the machine motor 49. 51 is upper shaft's rotational phase detecting means for detecting the rotational phase of the upper shaft of the machine.

52 is a stepping motor driver circuit for driving the embroidery frame having cloth spread on, 53 is an X-axis driving stepping motor which is driven by the driver circuit 52, and 54 is a Y-axis driving stepping motor.

The general operation of the embroidering machine as constructed above is described below with reference to the flowchart of FIG. 3.

First, when a power supply switch, not shown, is turned on to power the embroidering machine, the machine is initialized (step S1). Then, when mode selection is made from the mode selector means in operation key section 14 (step S2) and a normal sewing made is selected (step S3 is negative), the operation goes to step S4. When, in step S4, pattern selection is performed from pattern selecting section 13, the central processing unit 40 selects sewing data for the selected pattern from the interval pattern storage means 45.

Subsequently step S5 is entered, and when the user depresses the start/stop key 11 (step S6 is positive), central processing unit 40 responds to the detection signal from the upper shaft's rotational phase detector means 51 to read out sewing data from the internal pattern storage means 45 and supply it to the stepping motor driver circuit 52. Stepping motor driver circuit 52 drives X-axis driving stepping motor 53 and Y-axis driving stepping motor 54 on the basis of the supplied embroidering data. The sewing in the normal sewing mode is performed as described above (step S7).

Then, if there is keying in step S8 and this key is determined to be the start/stop key 11 (step S9 is positive), the normal sewing mode is terminated.

Description is now made to the operation of reading an original image pattern from the image reader 20 and producing embroidering data.

Before turning on the power of machine 10, the RAM card is set in the card reader/writer section 15, and then the power is turned on. Whereupon, the machine is initialized as previously stated (step S1). Then, mode selection is performed from the mode selector means in the operation key section 14 (step S2), and if the embroidering mode is selected (step S3 is affirmative), determination is made as to whether it is image input or embroidery sewing (step S10).

If it is determined to be image input by the input from operation key section 14 (step S10 is affirmative), the machine enters an image scanner input mode (step S11), and a message, for instance "Please depress the read start button of the image scanner." is displayed on the liquid crystal display section 12.

Then, the sewer places the sheet on which an original pattern is drawn on a flat surface, puts image scanner 20 on the sheet, and moves the image scanner 20 from the first to the last position while depressing the read start button 22. By this operation, the original image pattern is converted to binary data, which is stored in image data storage 41 provided in the machine.

Upon termination of the above storing, the process advances to step S12, where the binary data stored in the image data storage means 41 is stripped of noises and compressed by data processing means 42 and stored in processed data storage means 43. Incidentally, the processed data storage means 43 may be the same as the image data storage means 41.

The original image data stored in the processed data storage means 43 is displayed on liquid crystal display section 12. Then, if the machine user depresses the embroidering data conversion key in the operation key 14 after confirming that the input data contains no noise and thus the original data has successfully been input from the characters or pictures displayed on liquid crystal display section 12, embroidering data is generated by the image processing program stored in the program storage means 46 and stored in embroidering data storage means 44, or the RAM card (step S13).

Thus, the original image pattern read from image reader 20 is converted to embroidering data and stored in RAM card.

To embroider characters or pictures stored in a RAM card in this way, the start/stop key 11 is turned on (step S16 is affirmative) by keying (step S15). Whereupon the embroidering data is read out from the RAM card, and stepping motor driver circuit 52 drives the X-axis and Y-axis driving stepping motors 53 and 54 (step S17).

When the procedure flows from the step S10 to step S14, selection of an embroidering pattern is performed from the pattern selecting section 13. And, if start/stop key is turned on (step S16 is affirmative), the procedure goes to step S17 where the sewing of the embroidery pattern is executed.

In the embroidering machine constructed and operating as described above, the first embodiment of the present invention is characterised by improving the conversion process from the image to stitch data in step S13 of FIG. 3, thereby to enable a desired design to be produced within a figure without being affected by the visible outline thereof.

Figure 2:
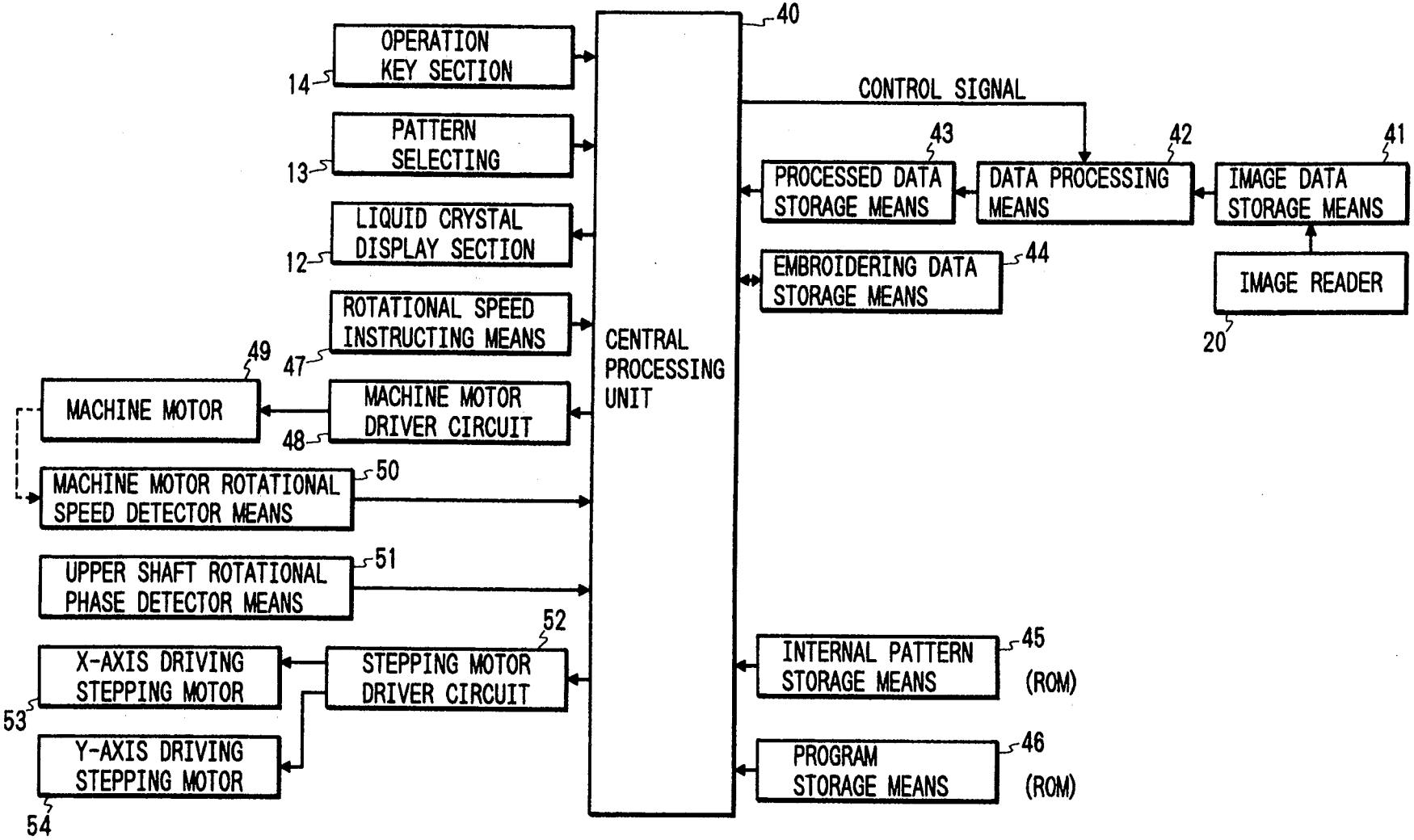
FIG. 2 is a block diagram showing the general hardware configuration of the embroidering machine.
Figure 4:
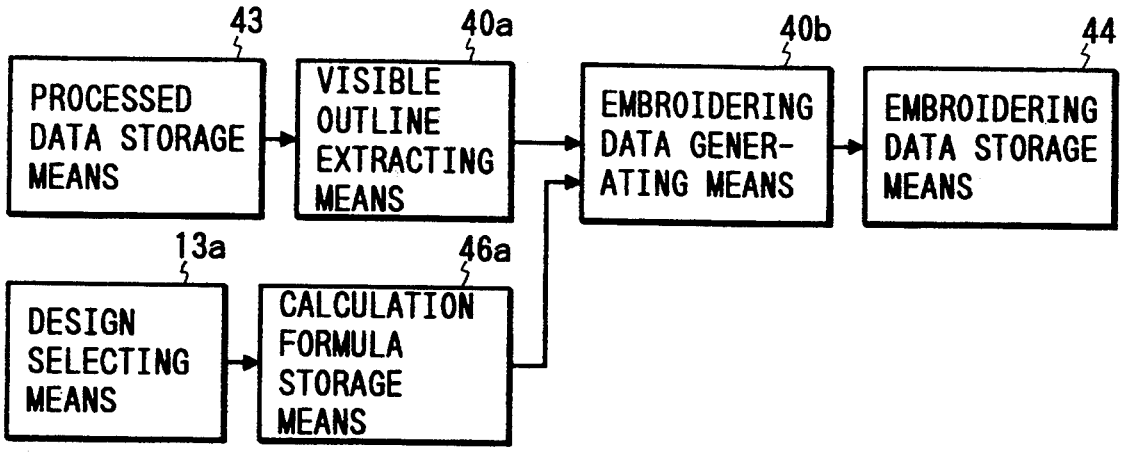
FIG. 4 is a functional block diagram of the first embodiment of the present invention.

FIG. 4 shows the functional block diagram of the first embodiment of the present invention. In the figure, those same as FIG. 2 are assigned the same symbols, and for the functions included in the blocks of FIG. 2, a suffix is added to the symbols of FIG. 2.

Figure 7:
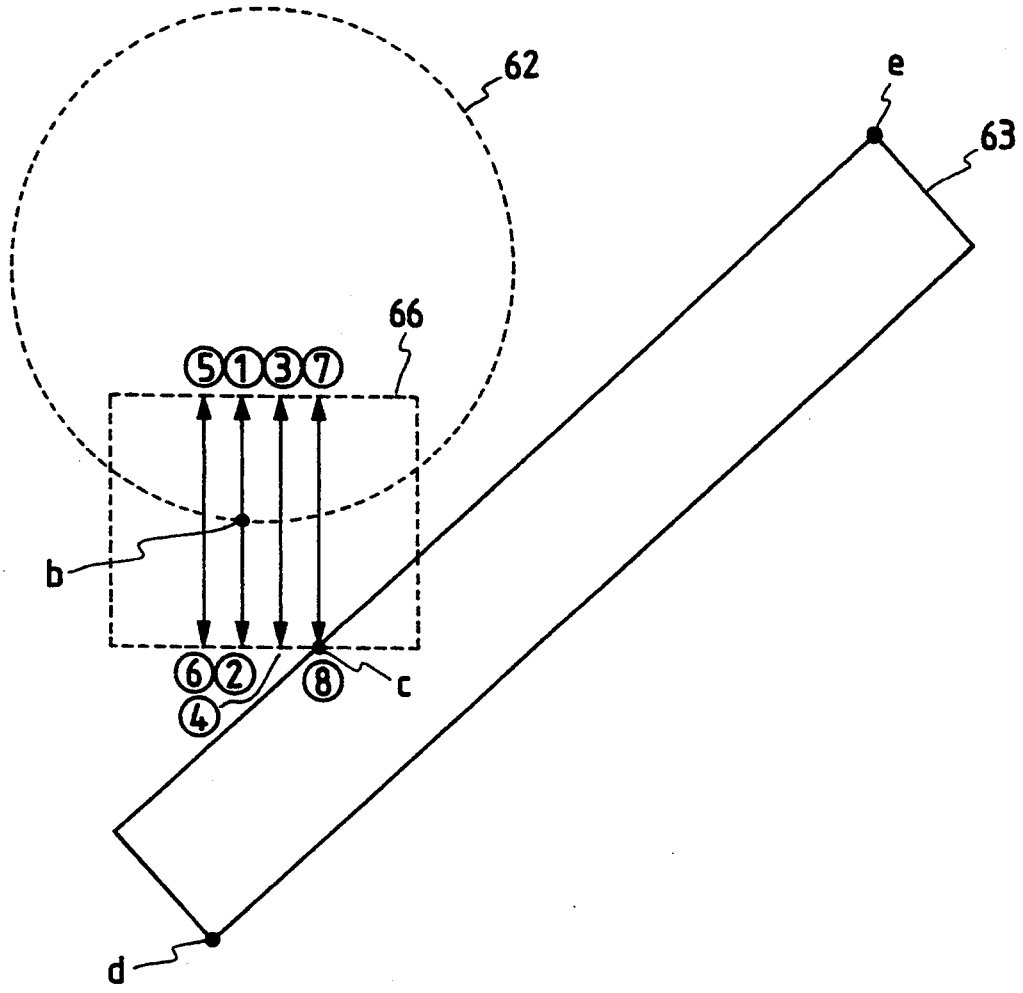

In processed data storage means 43, image data which has been stripped off noise or compressed, for instance, circular, rectangular and mountain-like image data are stored as shown in FIG. 7. Design selecting means 13*a* is provided in the pattern selecting section 18, and this is means for selecting a design such as a checkers pattern, diagonal pattern or stripe pattern.

46*a* is calculation formula storage means in which the formulas corresponding to the designs are stored, 40*a* is visible outline extracting means, and 40*b* is embroidering data generating means. The embroidering data generating means 40*b* generates embroidering data using the calculation formulas selected by the design selecting means 13*a* and image data from the visible outline extracting means 40*a*. The embroidering data generated by embroidering data generating means 40*b* is stored in embroidering data storage means 44.

The operation of this embodiment described above is now described in more detail with reference to FIGS. 5A and 5B. For simplicity, the description is made by referring to FIGS. 6 to 8 as needed. Here, it is assumed that the original image data in FIG. 6 consists of white data 61, circular, rectangular and mountain-like image blocks 62, 63 and 64 which are painted out with black.

Figures 5, 5A:
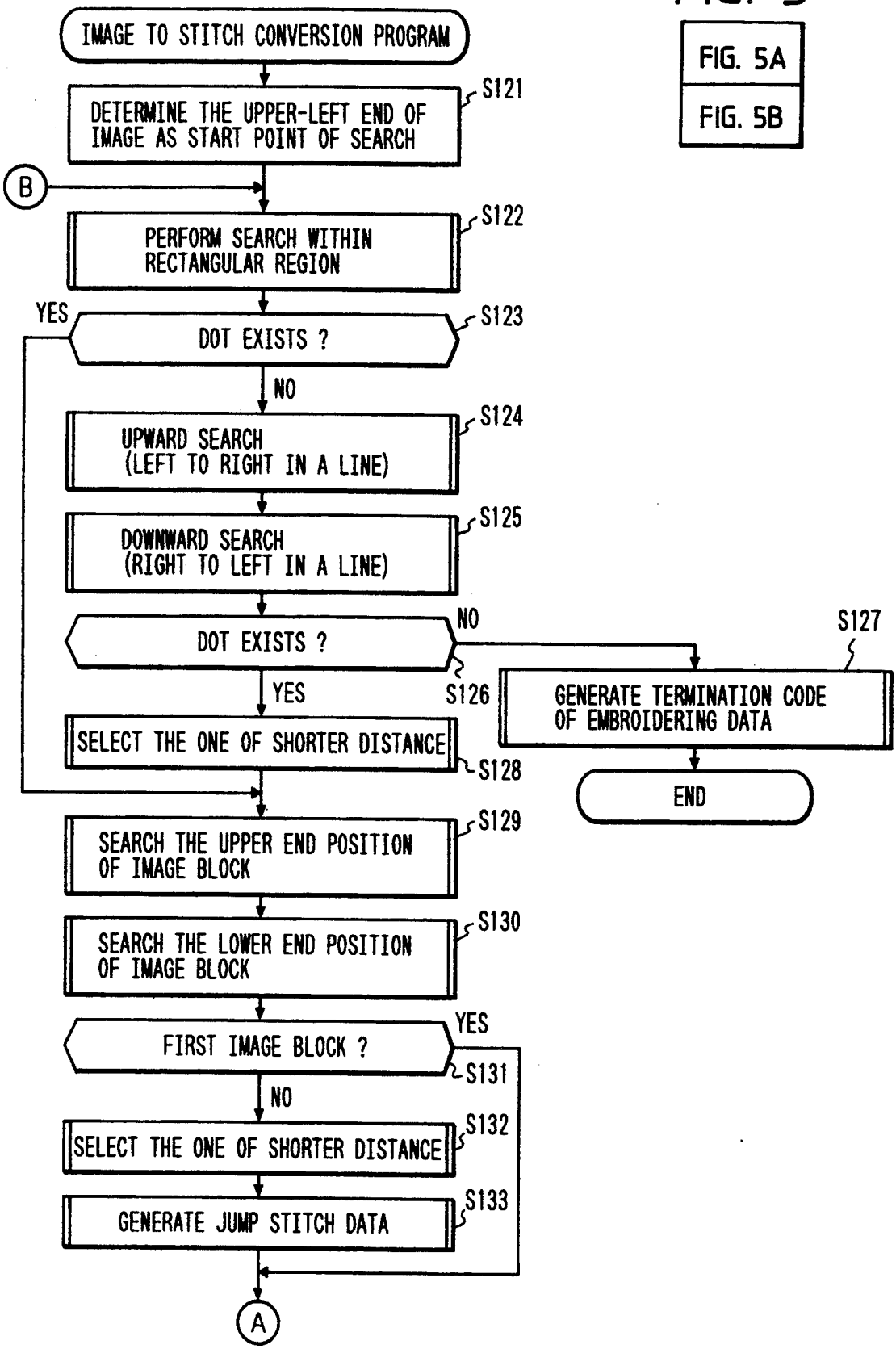
Figure 5B:
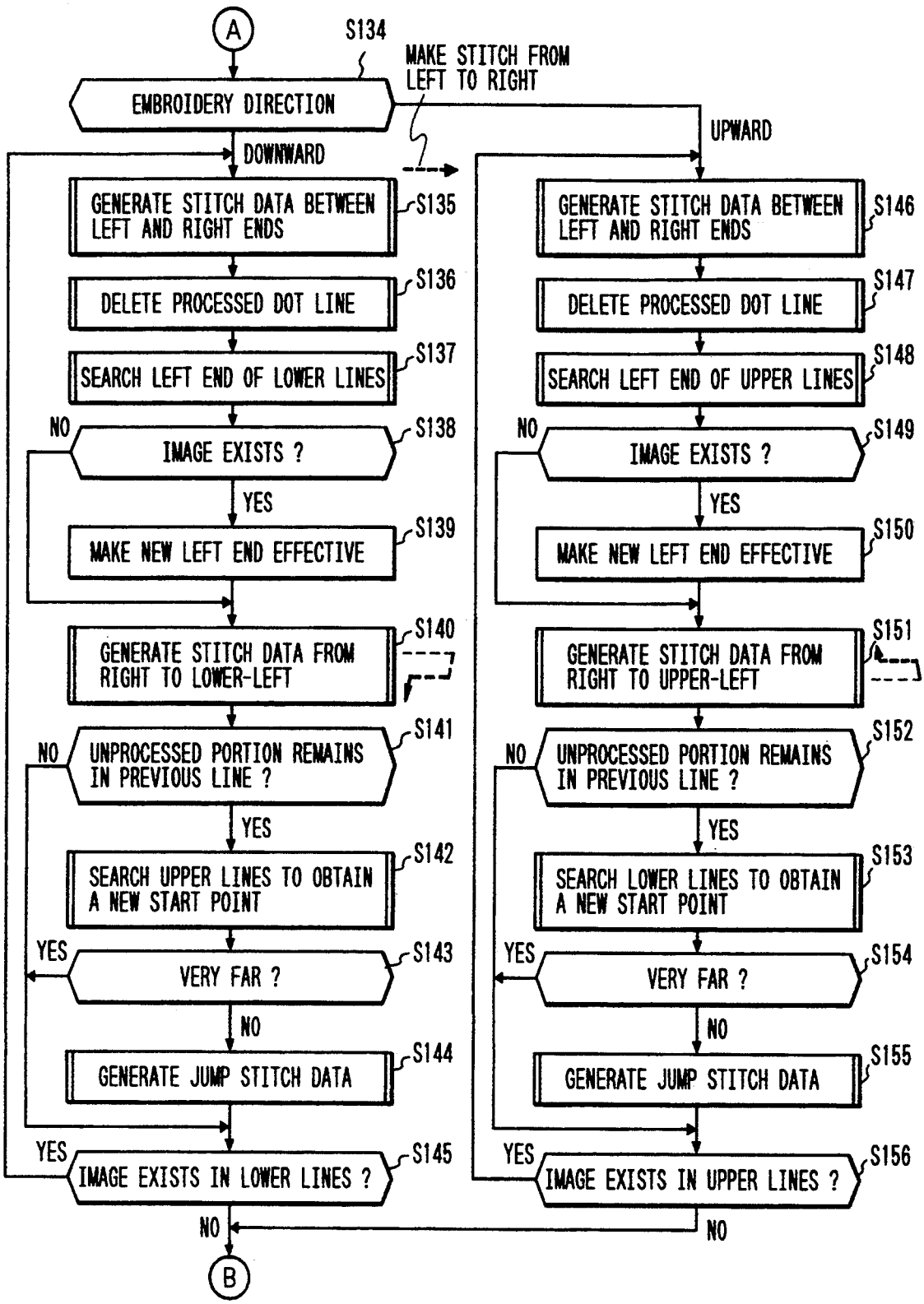

In step S121 of FIG. 5A, first an upper-left point (point 65 of FIG. 6) of the image is defined as the start point of search. In step S122, search is made within a rectangular region with the upper-left point being as one vertex, and it is judged whether or not black dots exist therein (step S123). If no dots exists (step S128 is negative), the process goes to steps S124 and S195 where search is made in the upward and downward directions from the upper-left point (refer to scan 71), and the existence of black dots is checked (step 8126). If it is judged in step S126 that there is no dots, the process goes to step S127 where the termination code of embroidering data is generated. On the other hand, if step S126 is affirmative, the process goes to step S128 where the dot of shorter distance is selected.

Figure 6:
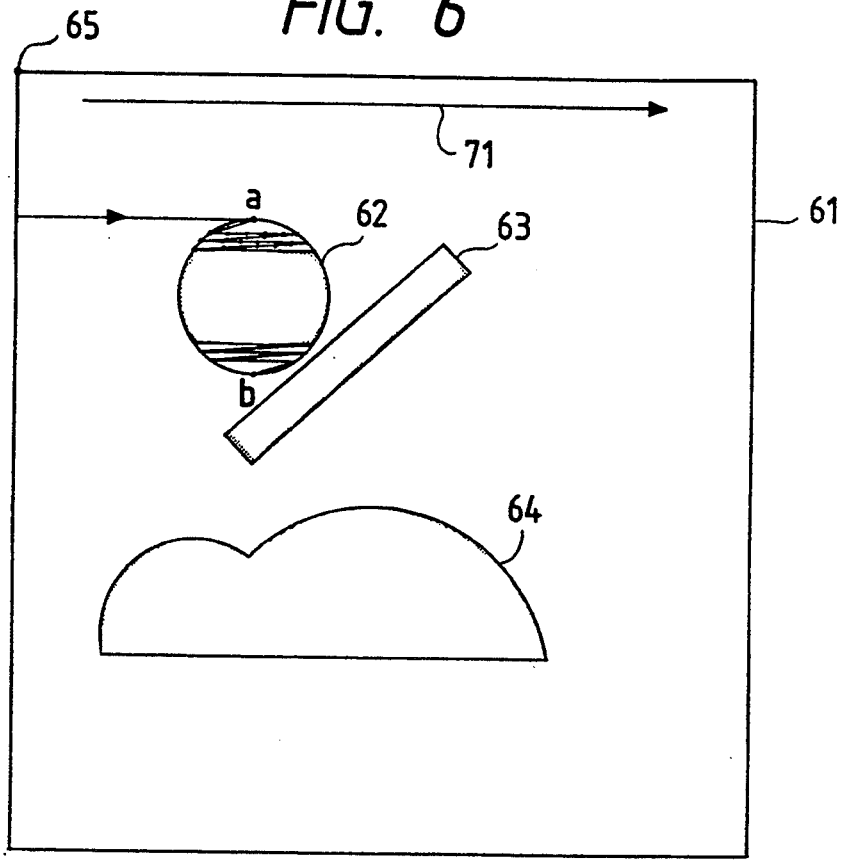
FIGS. 6, 7 and 8 are specific explanatory views of the flowchart.

In the example of FIG. 6, the upward search is not performed and only the downward search is performed to find point a of circular image block 62. Then, the process advances to steps S129 and S130 to search the upper end position a and lower end position b of the image block.

Subsequently, the judgment of step S131 is made, and step S134 is entered if the judgment is affirmative. In step S134, the downward embroidering direction is selected and the processings of step S135 to S145 are performed. By the processings, the embroidering data from point a to b of FIG. 6 is generated.

In step S135, stitch data obtained according to the method of the present invention is generated from the left end to the right end of dots. How to obtain the stitch data is later described in detail.

In step S136, the data of a processed dot string is deleted. In step S137, the left end of lower lines is searched to check the existence of an image. If there is an image, the process goes to step S140 where stitch data directed from the right to left end is generated according to the method of the present invention.

Then, the process advances to step S141 to check whether or not unprocessed dots are remaining in the previous lines. If there is unprocessed data, step S142 is entered to search the upper lines for a new start point. If the new start point is nearer than a predetermined distance (step S143 is negative), the process goes to step 8144 to generate a jump stitch. In step S145, it is judged whether or not image data exists in the lower lines, and if the judgment is affirmative, the process returns to step S135 to repeat the above described processings.

On the other hand, if it is judged that no image exists in the lower lines (step S145 is negative), the process returns to step S122, judging that conversion of one pattern block to embroidering data has terminated.

By the above operation, conversion to embroidering data of circular image block 62 of FIG. 6 to point b has been terminated. At this point, the image data of the circular image block 62 has been deleted by the action of the step S136.

In step S122, search is made within a rectangular region around point b which is the end point of the image block. That is, search is made within rectangular region 66 containing point b as shown in FIG. 7.

If a dot (point c) is found in the rectangular region 66 (step S123 is affirmative), the process goes to steps S129 and S130 to search the upper and lower end positions of image block 63. The point c is a dot among the dots of the image block to be next converted to embroidering data, which is near to the end point b of image block 62. Accordingly, this point c is referred to as a near point.

If the upper and lower end positions e and d are found in the steps S129 and S130, the judgment of step S131 is made. If this judgment is negative, step S132 is entered to select the end point having a shorter distance to the near point c.

Figure 8:
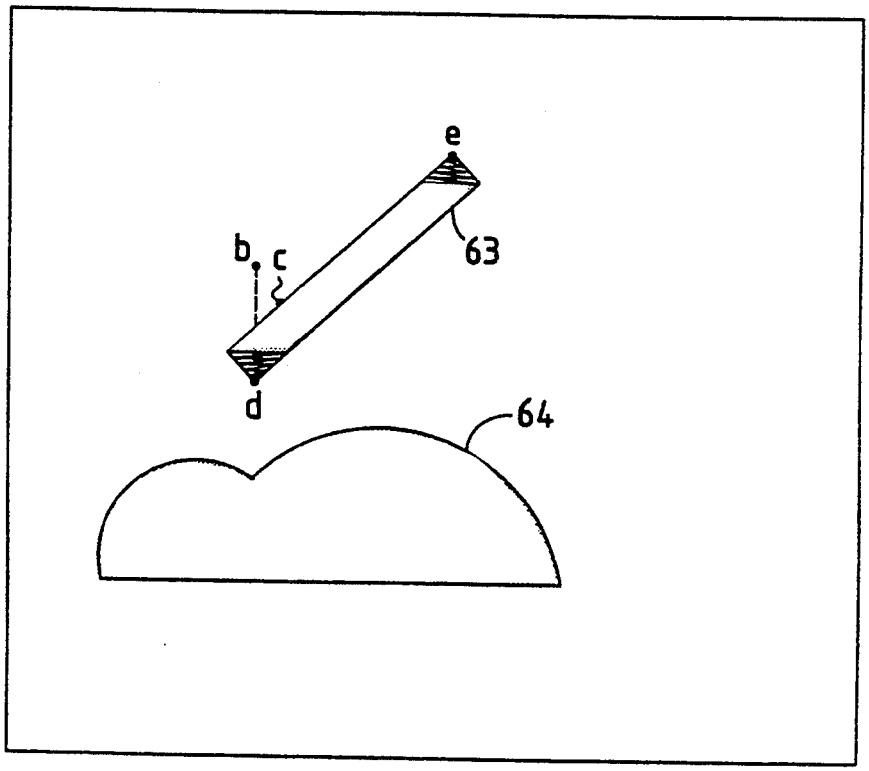

In step S133, the lower end position d which is the end point having a shorter distance is determined to be jump stitch data. As shown in FIG. 8, a jump stitch is formed from point b to the lower end position d.

Then, the process goes to step S134 to select the embroidering direction. The upward direction is selected in the case of FIG. 8, and by the steps S146 to S156, stitch data is sequentially produced from point d to point e. In steps S146 and S151, stitch data is formed according to the present invention.

If the judgment of step S156 is negative, conversion to embroidering data of image block 63 to point e, the upper end thereof, has been executed as shown in FIG. 8. When the conversion to embroidering data is executed, the image data of image block 68 is deleted. Since the operations of steps S146 to S156 are identical to those of the steps S135 to S145, the explanation thereof is omitted.

Subsequently, again returning to step S122, by executing a process similar to the foregoing, embroidering data is also formed for mountain-like image block 64. The present invention is to improve the steps S135, S140, S146 and S151, and it is described in detail according to the embodiments.

Figure 9A:
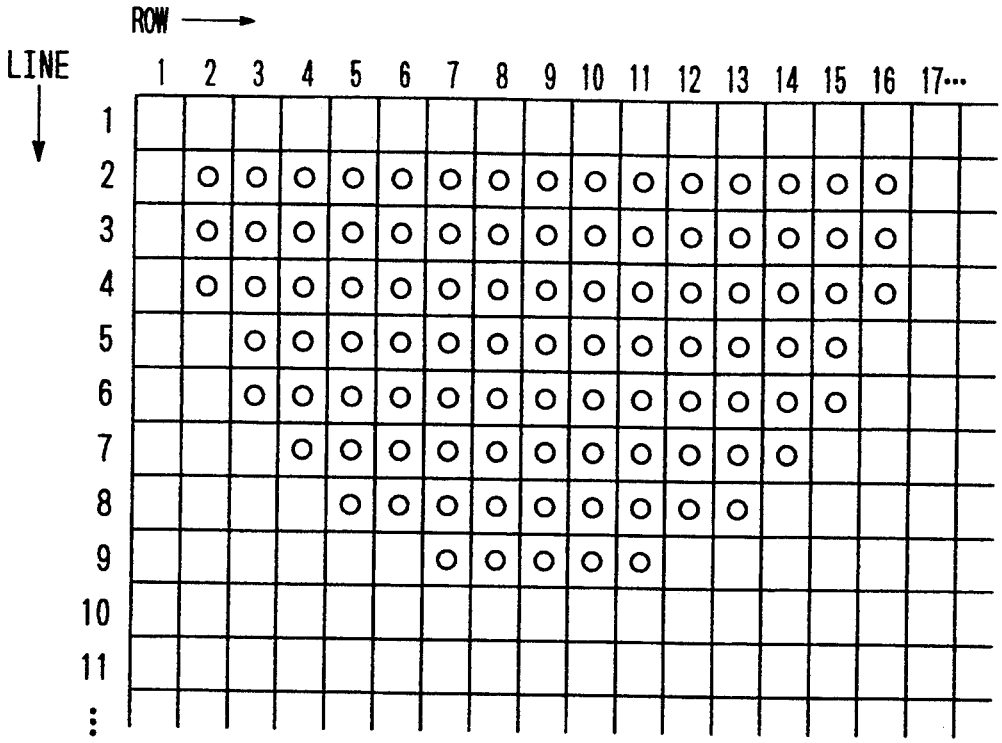
FIGS. 9A, 9B, 9C, 9E, and 9F are specific explanatory views of an embodiment of the present invention (checkers pattern).

It is now assumed that part of the image data of an original image stored in the processed data storage means 43 is a half-circle as shown in FIG. 9A, and the operation of this embodiment is more specifically described. Incidentally, needle locations are always on the visible outline of the original image to make the visible outline look beautifully.

(1) Production of a checkers pattern design (1-a) Needle locations from left to right In production of a checkers pattern design, the following formula (1) is used as the calculation formula for obtaining needle locations from left to right.

$$X=S+(4-S\%4)+(\text{Line}\%4) \quad (1)$$

In the above formula, X represents the value of a needle location in the X-axis direction (column direction), S the value of the preceding needle location in the column direction of the image data of the original image, % the remainder for the division, and Line the number of a line. S%4 and Line%4 represent the remainders of S-4 and Line-4, respectively.

Figure 9B:
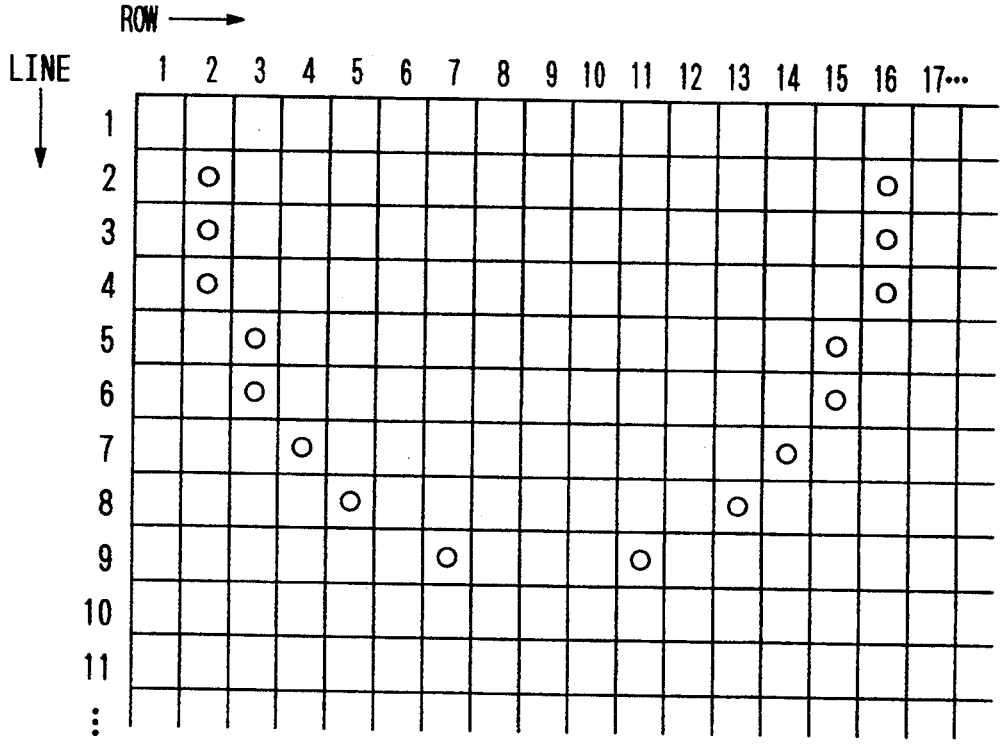

For the case of FIG. 9A, the outline of the original image is extracted as shown in FIG. 9B. If Line-2, the calculation of the formula (1) is started from S=2 on the visible outline. By substituting Line=2 and S=2 in the formula (1), the value of needle location X is obtained as follows.

$$X=2+(4-2\%4)+(2\%4)=2+(4-2)+2=6$$

where 2%4 represents the remainder of 2−4, the value of which is 2.

When needle location X=6 is obtained, then "4" (pitch) is added to the S=2 to make S=6, whereby the next needle location X is obtained. When Line=2 and S=6 are substituted in the formula (1) to obtain X, X=10 is obtained. Similarly, "4" is added to the S=6 to make S=10, whereby the next needle location X is obtained. When Line=2 and S=10 is substituted in the formula (1) to obtain X, X=14 is obtained. Since X=16 for the end point of the image data of the original image in the second line, the calculation for obtaining the needle locations of the second line terminates.

Figure 9C:
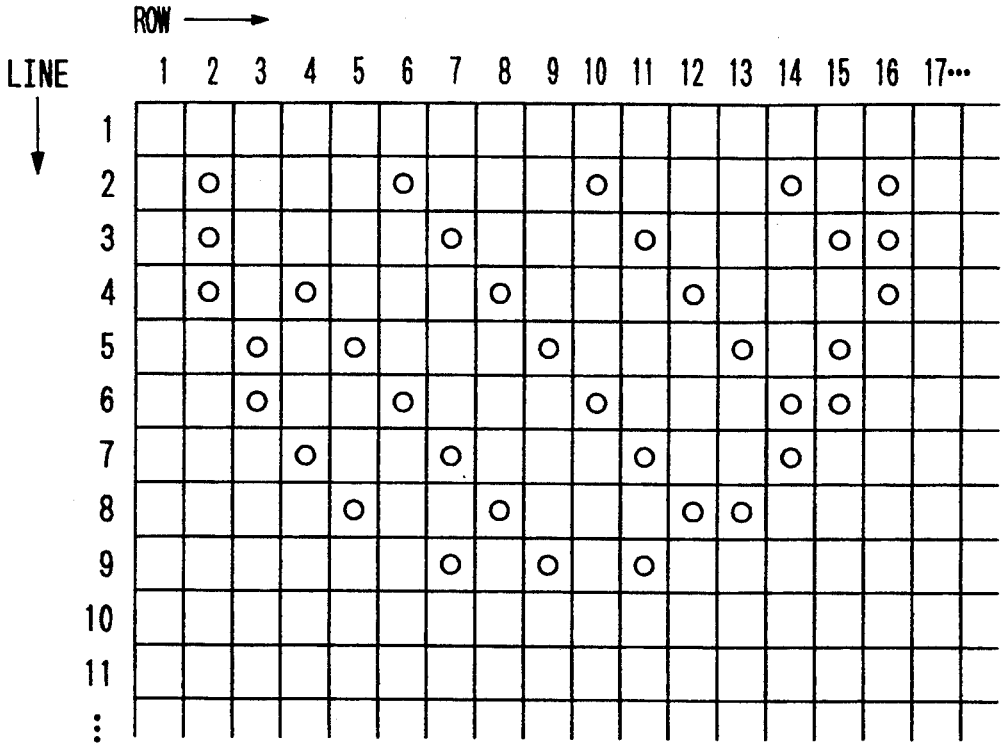

By the above calculation, the needle location data shown by white circles in the second line of FIG. 9C is obtained.

(1-b) Needle locations from right to left

Then, the calculation of needle locations back to the start point of the third line is performed from the end point. The following formula (2) is used as the calculation formula for obtaining needle locations from right to left.

$$X=E-(E\%4)-(\text{Line}\%4) \quad (2)$$

In the above formula, E represents the value of the end point needle location in the column direction of the image data of the original image, and the other symbols represent the same as the formula (1).

In the case of FIG. 9B, the end point of the second line is E=16. Then, if E=16 and Line=2 are substituted in the formula (2), the next needle location X is as follows.

$$X=16-(16\%4)-(2\%4)=16-0-2=14$$

When the needle location X=14 is obtained, "4" (pitch) is subtracted from the E=16 to make E=12, whereby the next needle location X is obtained. When Line=2 and E=12 are substituted in the formula (2) to obtain X, X=10 is obtained. Similarly, by subtracting "4" from the E=12 and substituting Line=2 and E=8 in the formula (2) to obtain X, X=6 is obtained. The calculation for obtaining the needle locations of the second line terminates because of X=2 for the start point of the image data of the original of the third line.

Figure 9D:
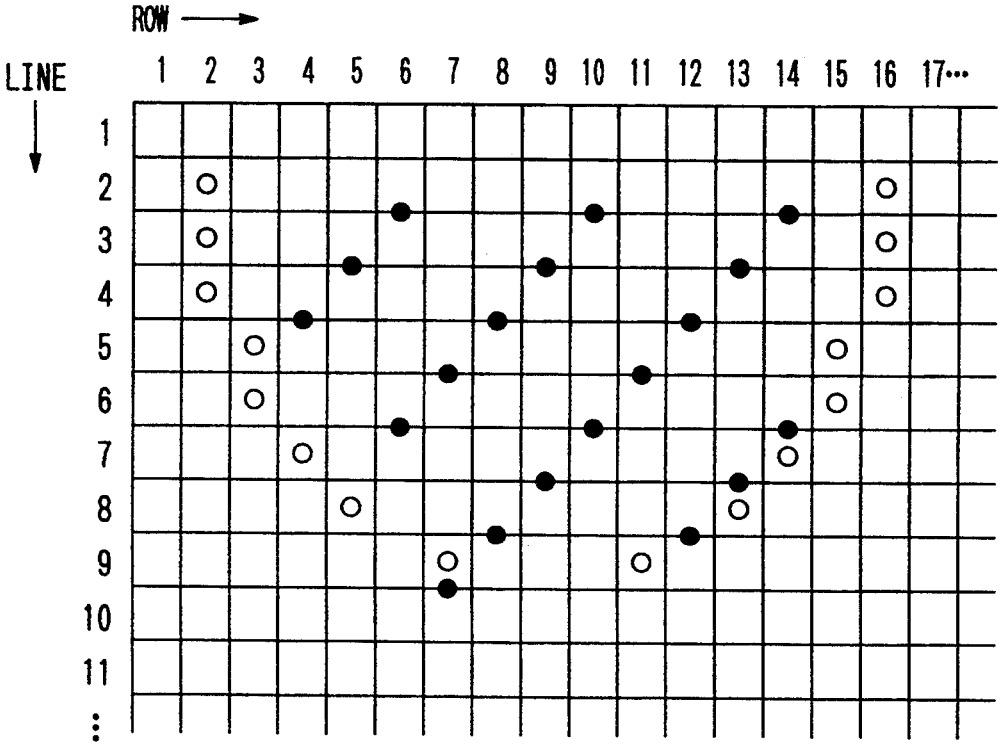

By the above calculation, the needle location data represented by black circles in the second line of FIG. 9D is obtained.

Then, data of the needle locations X from left to right of the third line (Line=3) is obtained in a manner similar to the (1-a). Only the result is shown as follows.

X=7 for Line=3 and S=2
X=11 for Line=3 and S=6
X=15 for Line=3 and S=10

Then, data of the needle locations X from right to left of the third line (Line=3) is obtained in a manner similar to the (1-b). Only the result is shown as follows.

X=13 for Line=3 and E=16
X=9 for Line=3 and S=12
X=5 for Line=3 and S=8

Subsequently, data is obtained for the needle locations X of the fourth line, fifth line, . . . in a manner similar to the foregoing. The needle locations X obtained from the above results are collectively shown in FIGS. 9C and 9D. It is seen from FIGS. 9C and 9D that the needle locations of white circles shift to the right by one dot for each line and the needle locations of black circles shift to the left by one dot for each line.

Figure 9E:
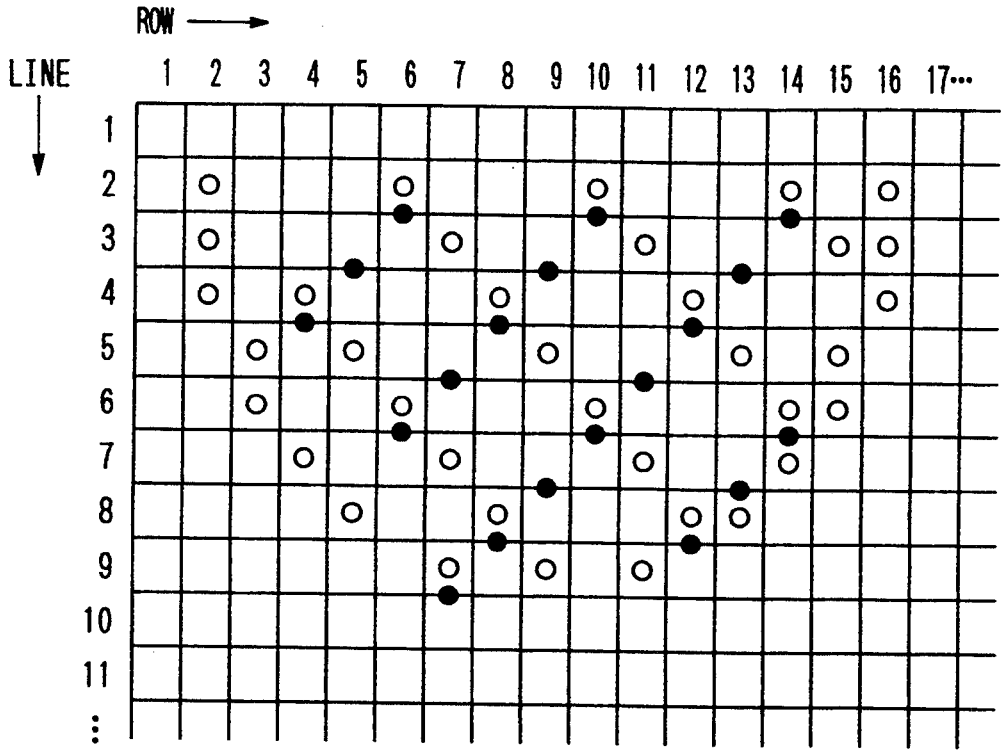
Figure 9F:
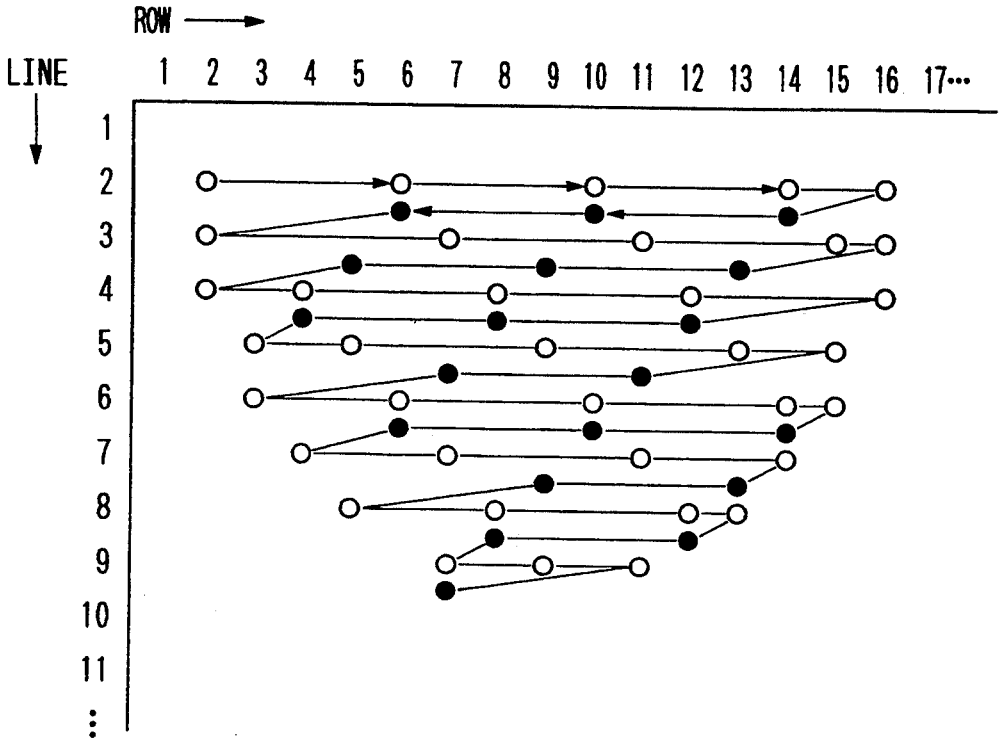

FIG. 9E shows a combination of the needle locations from left to right and the needle locations from right to left, and it is seen that the needle locations form a checkers pattern which is not affected by the visible outline of the image data of the original image. FIG. 9F shows the embroidery sequence by an embroidery thread.

(2) Production of a stripe pattern design

To produce a stripe pattern design, the following calculation formulas are used instead of the formulas (1) and (2).

(2-a) Needle location X from left to right $$X=S+(4=S\%4)$$

(2-b) Needle location X from right to left $$X=E-(E\%4)$$

Figure 10:
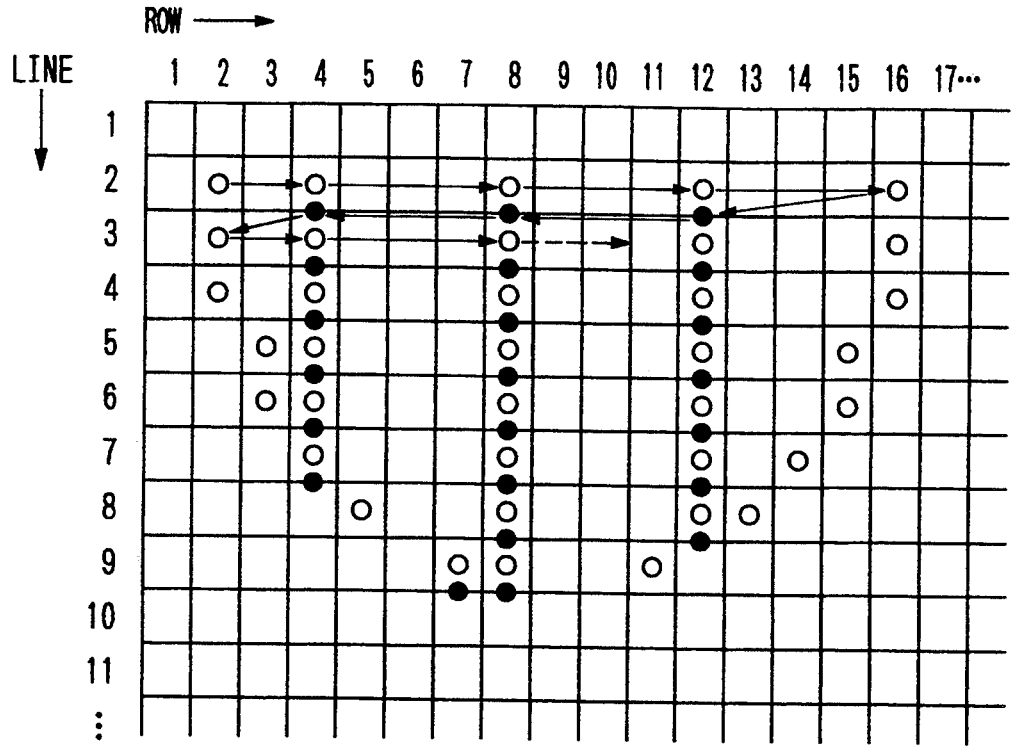
FIG. 10 is a specific explanatory view of an embodiment of the present invention (stripe pattern).

By applying the above formulas to the half-circle original image data of FIG. 9A, the needle locations as shown in FIG. 10 is obtained, whereby a stripe pattern design can be produced.

(3) Production of a diagonal pattern design

To produce a diagonal pattern design, the following formulas are used instead of the formulas (1) and (2).

(3-a) Needle locations X from left to right $$X=S+(4-S\%4)+(\text{Line}\%4)$$

(3-b) Needle locations X from right to left $$X=E-(E\%4)-(4-\text{Line}\%4)$$

Figure 11:
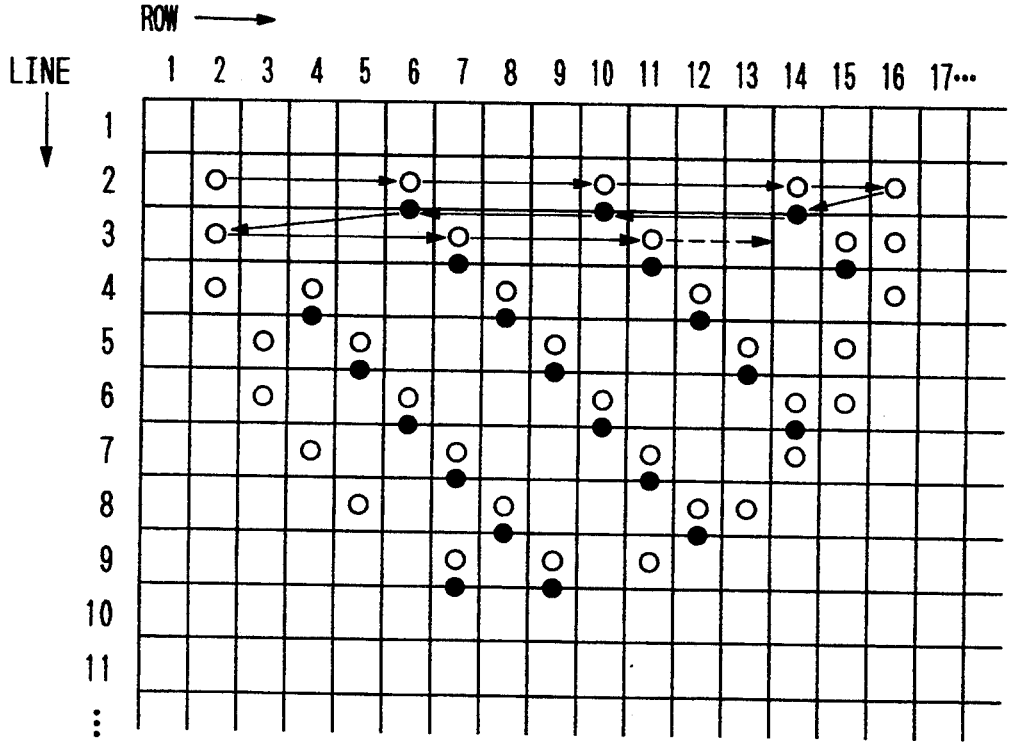
FIG. 11 is a specific explanatory view of an embodiment of the present invention (diagonal pattern).

By applying the above formulas to the half-circle original image data of FIG. 9A, the needle locations as shown in FIG. 11 is obtained, whereby a diagonal pattern design can be produced.

Although, in the above description, the needle locations X from left to right and the needle locations X from right to left have been obtained alternately for each line and stored in embroidering data storage means 44, the present invention is not limited to this, but it is possible to first obtain all the needle locations X from left to original image data of FIG. 9A, the needle locations as shown in FIG. 11 is obtained, whereby a diagonal pattern design can be produced.

Although, in the above description, the needle locations X from left to right and the needle locations X from right to left have been obtained alternately for each line and stored in embroidering data storage means 44, the present invention is not limited to this, but it is possible to first obtain all the needle locations X from left to right and store them in embroidering data storage means 44, and then obtain all the needle locations X from right to left and store them in embroidering data storage means. Also, the needle locations from left to right and those from right to left may be obtained in another sequence and stored in embroidering data storage means 44. In addition, the above description has been made for an example having a needle location pitch of 4, but the present invention is not limited to this.

Figure 12:
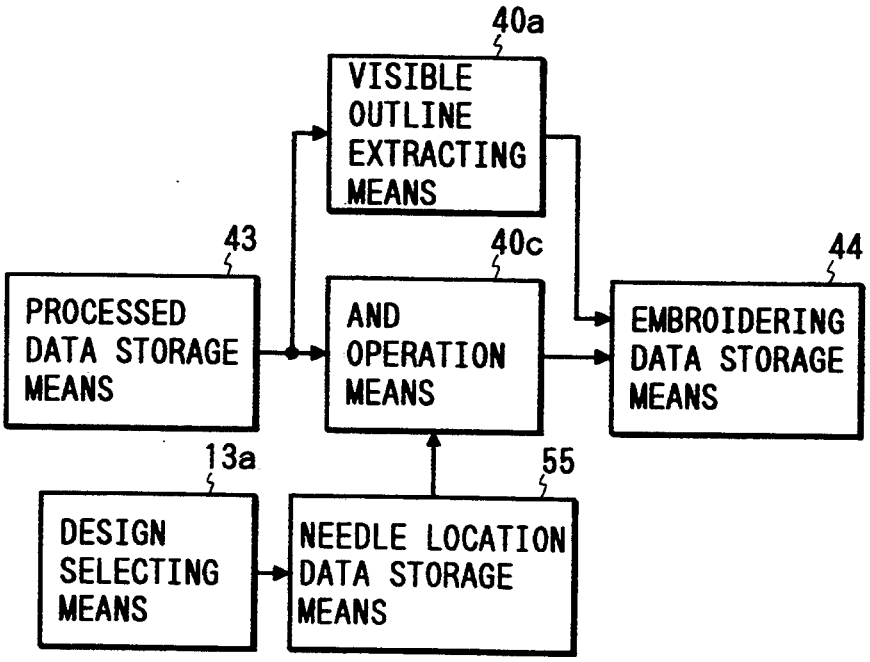
FIG. 12 is a functional block diagram of the second embodiment of the present invention.

Now, the second embodiment of the present invention is described with reference to the functional block diagram of FIG. 12.

In the figure, 55 is needle location data storage means, in which needle location data are prestored for each design. 40*c* is AND operation means for performing the logical product operation (AND operation) of the image data read out from processed data storage means 43 and the data in needle location data storage means 55.

An example of the operation of this embodiment is described below with reference to FIG. 13A to 13C.

Figure 13A:
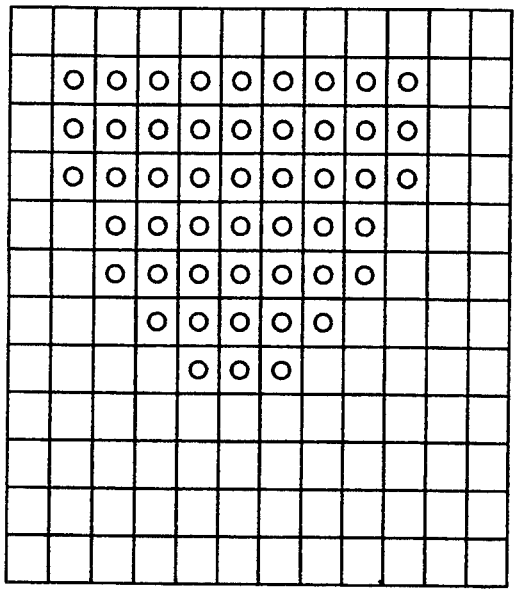
FIGS. 13A, 13B, and 13C are specific explanatory view of the second embodiment.
Figure 13B:
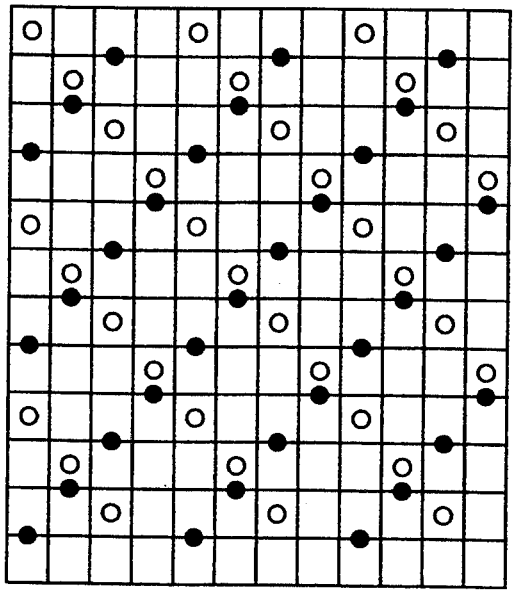

Now, it is assumed that the semicircular image data of FIG. 13A is stored in processed data storage means 43. On the other hand, it is supposed that the needle location data for a checkers pattern as shown in FIG. 13B is selected from the needle location data storage means 55 by design selecting means 13*a*.

When the operation is started, visible outline extracting means extracts and stores visible outline data in embroidering data storage means 44. AND operation means 40*c* performs the AND operation of the image data of FIG. 13A and the needle location data of FIG. 13B and stores the result in the embroidering data storage means 44.

Figure 13C:
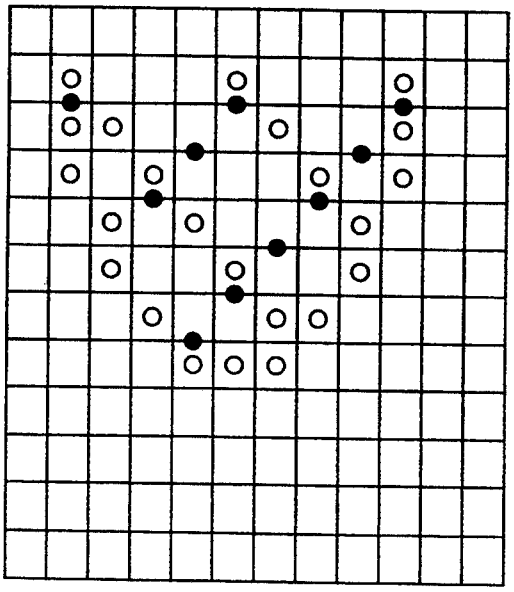

When this operation has been performed for all the data, embroidering data as shown in FIG. 13C can be obtained in which the inside of the semicircular shape is filled up with checkers.

Since the needle location data of designs such as stripe and diagonal patterns in addition to checker patterns are stored in the needle location data storage means 55, these designs can freely be selected from design selecting means 13*a*.

As obvious from the above description, the present invention provides an effect that a desired design can be produced within a figure without being affected by the visible outline thereof. This also provides for an expectation of the effect that the embroidery pattern looks beautiful.

Although the above description has been made for the case that image data storage means 41, data processing means 42, processed data storage means 43 and embroidering data storage means are existing in the embroidering machine main body, the present invention is not limited to this and they may be provided in a separate sewing data production system. Description of such sewing data production system is omitted, because it is described in detail, for instance, in Japanese Patent Application No. 266462/1990 by the present applicant.

What is claimed is:

1. An embroidering data production system for a sewing machine having a needle and for producing embroidering data from an image data of an original pattern from an image input means operably connected to the sewing machine, the embroidering data production system comprising:

image data storage means for storing therein the image data, the image data having a plurality of lines and columns, both of which having sequentially incrementing numbers attached thereto from an initial number to a last number representing stitching directions and sequences thereof;

extraction means operably connected to the image data storage means for extracting an outline of the original pattern for determining positions at which the needle is destined to drop;

selection means for selecting a design to be embroidered within the original pattern which is stitched in accordance with the image data;

calculation formula storage means having calculation formulas stored therein operably connected to the selection means for determining positions at which the needle is destined to drop in accordance with the design;

embroidering data generation means operably connected to the calculation means and to the extraction means for applying the calculation formulas to the initial line numbers and the last column numbers defining the outline of the original pattern, thereby sequentially generating embroidering data representing the design of the image data; and embroidering data storage means operably connected to the embroidering data generation means for storing therein the embroidering data.

2. An embroidering data production system as set forth in claim 1 wherein the calculation formulas stored in said calculation formula storage means include at least one of the formulas representing a checkers pattern, a stripe pattern and a diagonal pattern.

3. An embroidering data production system as set forth in claim 2 wherein the calculation formulas representing said checkers pattern are as follows:

(a) left to right needle location (=X)

$$X=S+(4-S\%4)+(\text{Line}\%4)$$

(b) right to left needle location (=X)

$$X=E-(E\%4)-(\text{Line}\%4)$$

where X represents the value of a needle location in the X-axis direction (column direction), S the value of the needle location of the start point in the column direction of the image data of an original image, E the value of the needle location of the end point in the column direction of the image data of the original image, % the remainder for division, and Line a line number.

4. An embroidering data production system as set forth in claim 2 wherein the calculation formulas representing said stripe pattern are as follows:

(a) left to right needle location (=X)

$$X=S+(4-S\%4)$$

(b) right to left needle location (=X)

$$X=E=(E\%4)$$

where X represents the value of a needle location in the X-axis direction (column direction), S the value of the needle location of the start point in the column direction of the image data of an original image, E the value of the needle location of the end point in the column direction of the image data of the original image and % the remainder for division.

5. An embroidering data production system as set forth in claim 2 wherein the calculation formulas representing said diagonal pattern are as follows:

(a) left to right needle location (=X)

$$X=S+(4-S\%4)+(\text{Line}\%4)$$

(b) right to left needle location (=X)

$$X=E-(E\%4)-(4-\text{Line}\%4)$$

where X represents the value of a needle location in the X-axis direction (column direction), S the value of the needle location of the start point in the column direction of the image data of an original image, E the value of the needle location of the end point in the column direction of the image data of the original image, % the remainder for division, and Line a line number.

6. An embroidering data production system for a sewing machine having a needle and for producing embroidering data from an image data of an original pattern taken from an image input means operably connected to the sewing machine, the embroidering data production system comprising:

image data storage means for storing therein the image data, the image data being arranged in a plurality of lines and columns;

extraction means operably connected to the storage means for extracting an outline of the original pattern for determining the positions at which the needle is destined to drop;

selection means for selecting a design to be stitched within the pattern which is stitched in accordance with the image data;

defining means operably connected to the selection means, the defining means having needle positioning data stored therein for defining the design;

boolean operation means operably connected to the defining means and image data storage means for sequentially checking the image data in reference to the needle positioning data so as to generate embroidering data on the basis of the image data and the needle positioning data; and embroidering data storage means operably connected to the boolean operation means for storing therein the generated embroidering data and the outline.

7. The embroidering data production system as set forth in claim 6, wherein the needle positioning data includes at least one of the formulas representing a checkers pattern, a stripe pattern, and a diagonal pattern.

* * * * *